US010985452B2

(12) United States Patent
Hung

(10) Patent No.: US 10,985,452 B2
(45) Date of Patent: Apr. 20, 2021

(54) ANTENNA ELEMENTS

(71) Applicant: Hewlett-Packard Development Company, L.P., Spring, TX (US)

(72) Inventor: Kuan-Jung Hung, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/603,855

(22) PCT Filed: Apr. 17, 2017

(86) PCT No.: PCT/US2017/027947

§ 371 (c)(1),
(2) Date: Oct. 9, 2019

(87) PCT Pub. No.: WO2018/194546

PCT Pub. Date: Oct. 25, 2018

(65) Prior Publication Data

US 2020/0119436 A1 Apr. 16, 2020

(51) Int. Cl.

| | |
|---|---|
| ***H01Q 1/48*** | (2006.01) |
| ***H01Q 1/38*** | (2006.01) |
| ***H01Q 13/10*** | (2006.01) |
| ***H01Q 5/321*** | (2015.01) |
| ***H01Q 9/42*** | (2006.01) |
| ***H01Q 5/328*** | (2015.01) |
| *H01Q 1/22* | (2006.01) |

(52) U.S. Cl.

CPC ..... *H01Q 1/38* (2013.01); *H01Q 1/48* (2013.01); *H01Q 5/321* (2015.01); *H01Q 5/328* (2015.01); *H01Q 9/42* (2013.01); *H01Q 13/10* (2013.01); *H01Q 1/2266* (2013.01)

(58) Field of Classification Search

CPC ..... H01Q 1/38; H01Q 1/48; H01Q 1/2258; H01Q 13/10; H01Q 5/321; H01Q 5/328; H01Q 9/42

See application file for complete search history.

(56) References Cited

U.S. PATENT DOCUMENTS

| | | | |
|---|---|---|---|
| 4,827,266 A | 5/1989 | Sato et al. | |
| 9,564,679 B2 * | 2/2017 | Rho | H01Q 1/243 |

(Continued)

FOREIGN PATENT DOCUMENTS

| | | |
|---|---|---|
| EP | 2197074 B1 | 12/2012 |
| JP | 2012015909 A | 1/2012 |
| WO | WO-2006118587 A1 | 11/2006 |

OTHER PUBLICATIONS

Hung, C. et al., Design of Slot Antenna Loaded with Lumped Circuit Components, Oct. 23-25, 2013, < http://ieeexplore.ieee.org/document/6717714/ >.

*Primary Examiner* — Hoang V Nguyen
(74) *Attorney, Agent, or Firm* — HPI Patent Department

(57) ABSTRACT

Examples of antenna elements are described herein. In an example, the antenna element may include a substrate for being disposed on an enclosure. The substrate may include a ground plane. Further, the antenna element may include an antenna feeder that may be electrically coupled to the ground plane. The antenna element may also include a radiator. The radiator may be electrically coupled to the antenna feeder. In addition, the antenna element may include a lump component connected to the radiator.

11 Claims, 8 Drawing Sheets

(56) References Cited

U.S. PATENT DOCUMENTS

| | | | | |
|---|---|---|---|---|
| 9,716,307 | B2 * | 7/2017 | Tsai | H01Q 13/106 |
| 2009/0015507 | A1 | 1/2009 | Hong et al. | |
| 2010/0321253 | A1 | 12/2010 | Vazquez et al. | |
| 2011/0012794 | A1 | 1/2011 | Schlub et al. | |
| 2011/0260939 | A1 | 10/2011 | Korva et al. | |
| 2014/0340265 | A1 | 11/2014 | Vazquez et al. | |
| 2015/0303568 | A1 | 10/2015 | Yarga et al. | |
| 2015/0311594 | A1 | 10/2015 | Zhu et al. | |
| 2015/0340757 | A1 | 11/2015 | Rho et al. | |
| 2016/0190690 | A1 | 6/2016 | Badran et al. | |
| 2016/0226132 | A1 | 8/2016 | Kim et al. | |

* cited by examiner

ANTENNA ELEMENTS

BACKGROUND

Electronic devices, such as mobile devices, tablets, and computers, may be provided with an antenna for wireless communication. Antennas used in the electronic devices have evolved from being deployed at an outer surface of the electronic device to be included within the electronic device. Antennas may be of many different types and are used in the electronic devices, based on a frequency demand of the electronic device.

BRIEF DESCRIPTION OF DRAWINGS

The following detailed description references the drawings, wherein.

DETAILED DESCRIPTION

Figure 1:
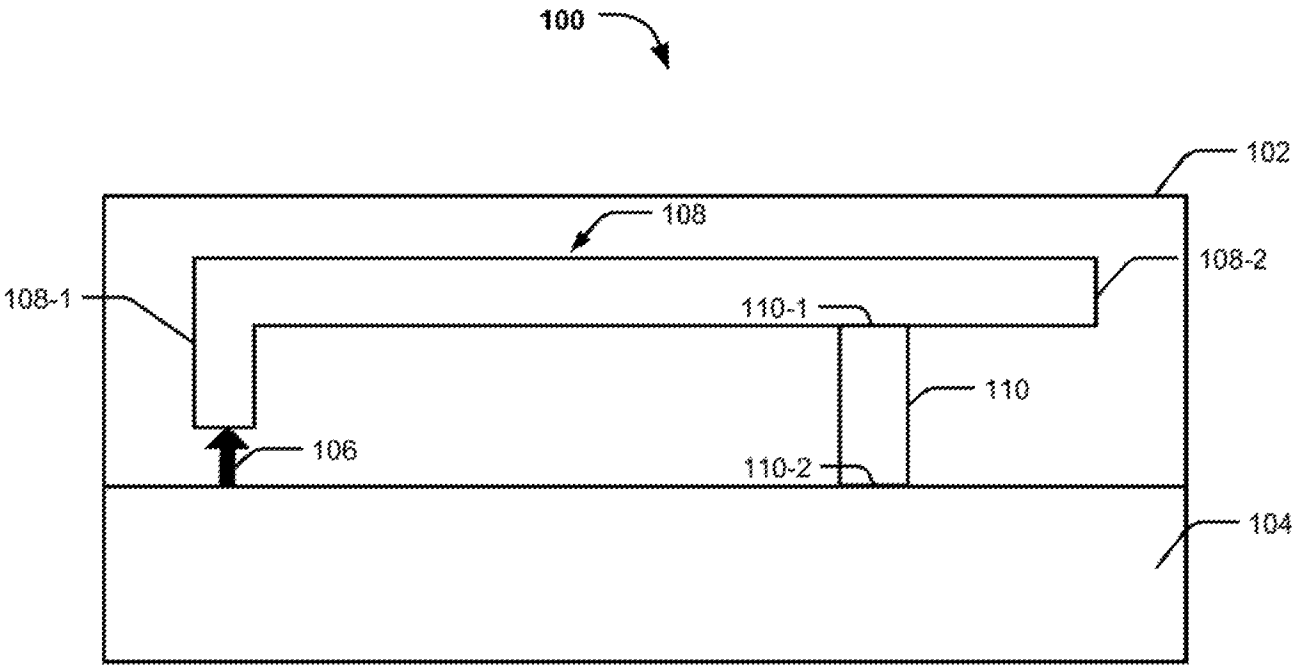
FIG. 1 illustrates an antenna element, according to an example.

Antennas may be provided in electronic devices to impart wireless communication capabilities in the electronic devices. Examples of the antennas may, include, but are not limited to, a monopole, a dipole, a slot antenna, and a patch antenna. Application of the antennas may be dependent on a profile, such as a height and width, of the antenna. For example, owing to the low profile of slot antennas, most electronic devices are provided with slot antennas. A slot antenna includes a metal surface with a slot cut out. When the plate is driven as an antenna by a driving frequency, the slot radiates electromagnetic waves. In addition, slot antennas offer ease of integration in electronic devices of various form factors. Examples of the electronic devices may include, but are not limited to, laptops, smartphones, and tablets.

Generally, slot antennas include a radiator coupled to an antenna feeder. The radiator facilitates in radiating radio waves and the antenna feeder feeds the radio waves to various components of the antenna. The coupling of the antenna feeder with the radiator reduces efficiency of the antenna to convert input power or radio waves. Thus, the slot antennas operate at a single frequency band to cater to either low frequency band or high frequency band demands of the electronic devices. Use of slot antennas at a single frequency band results in reduced antenna gain due to insufficient impedance bandwidth.

With the advent of technology, electronic devices are capable of transceiving signals in more than one frequency band. To enable electronic devices to transmit and receive signals in multiple frequency bands, multiple antennas are employed in the electronic devices. However, the use of multiple antennas, one for each of the frequency bands, may be inefficient in terms of space consumption in the electronic devices. Besides, each of the multiple antennas may have components of their own, which leads to an increase in the cost and complexity of the electronic devices.

The present subject matter describes an antenna element, an enclosure for an electronic device, and an electronic device implementing the antenna element in accordance with aspects of the present subject matter. The antenna element of the present subject matter creates resonance in multiple frequency bands, thereby increasing the impedance bandwidth of the electronic device. Accordingly, the antenna element of the present subject matter facilitates transceiving signals in more than one frequency band.

According to an aspect of the present subject matter, the antenna element may include a substrate having a ground plane. The ground plane may be a portion of the substrate that does not include any electrical component. The substrate may be disposed on a conductive enclosure of the electronic device. In an example, the conductive enclosure may be a body or housing of the electronic device. The antenna element may further include an antenna feeder electrically coupled to the ground plane to feed the radio waves. In addition, the antenna element may include a radiator connected to the antenna feeder to cause excitation of a slot in the conductive enclosure.

The antenna element may also include a lump component connected to the radiator. In an example, based on the frequency demands of the electronic device, more than one lump component may be connected to the radiator, either in series or parallel or both. Further, the connection between the lump component and the radiator defines the behaviour of an antenna. The lump component when connected to the radiator, facilitates in creating more resonance, thereby addressing the bandwidth demands of the electronic devices and enables reception of signals at multiple frequency bands.

The above aspects are further described in conjunction with the following figures and associated description below. It should be noted that the description and figures merely illustrate the principles of the present subject matter. Further, various arrangements may be devised that, although not explicitly described or shown herein, embody the principles of the present subject matter and are included within its scope. The manner in which the systems depicting various implementation of an antenna are explained in detail with respect to FIGS. 1-8.

FIG. 1 illustrates an antenna element 100, according to an example. The antenna element 100 may be disposed over a slot of an enclosure, such as a conductive enclosure of an electronic device. The antenna element 100 includes a substrate 102, such as a Printed Circuit Board (PCB). In an example, the substrate 102 may be made of a flexible material, such as plastic. The substrate 102 may be disposed on the conductive enclosure of the electronic device (not shown in FIG. 1). Further, the substrate 102 includes a ground plane 104. The ground plane 104 may act as a reflecting surface for radio waves. The ground plane 104 may be made of copper foil. The copper foil may be connected to the conductive enclosure and may serve as a return path for current from different components on the substrate 102. The ground plane 104 may also reduce any electrical noise that may be created due to adjacent circuit traces.

In an example, the antenna element 100 includes an antenna feeder 106 electrically coupled to the ground plane 104. The antenna feeder 106 may feed radio waves into the antenna element 100. The antenna feeder 106 may also be used for collecting incoming radio waves, converting them to electric currents and transmitting the electric current to a receiver (not shown). In an example, the antenna feeder 106 may be a line feed, a coaxial feed, a micro-strip feed, and the like.

Further, the antenna element 100 includes a radiator 108. The radiator 108 may be made of a metal trace. In an example, a first end 108-1 of the radiator 108 is connected to the antenna feeder 106 to cause excitation of a slot of the conductive enclosure. Further, a second end 108-2 of the radiator 108 is free, i.e., not connected to any component. In an example, the radiator may be a single element or may be segmented. In an example, the radiator 108 may have different shapes based on frequency demands of the electronic device. Examples of the shapes of the radiator 108 may include, but are not limited to, a L shaped radiator, a T shaped radiator, and an E shaped radiator.

The antenna element 100 also includes a lump component 110 connected to the radiator 108. The lump component 110 may be a capacitor, an inductor or a resistor. In an example, the lump component 110 is connected to the radiator 108 in parallel. For parallel connection, one end 110-1 of the lump component 110 is connected to the radiator 108 and another end 110-2 of the lump component 110 is connected to the ground plane 104, as shown in FIG. 1. Due to the connection of the lump component 110 with the radiator 108, more resonance is created, as a result antenna performance is enhanced.

In an example, the connection between the lump component 110 and the radiator 108 causes a change in behaviour of the radiator 108, For example, when the lump component 110 is shunted between the radiator 108 and the ground plane 104, the radiator 108 may act as a loop. As a result, the antenna thus formed act as a loop antenna Further, multiple lump components may be connected in different manners to the radiator to enhance the frequency bandwidth of the electronic device. The lump component 110 may accordingly enable the electronic device to receive signals at multiple frequency bands.

Figure 2:
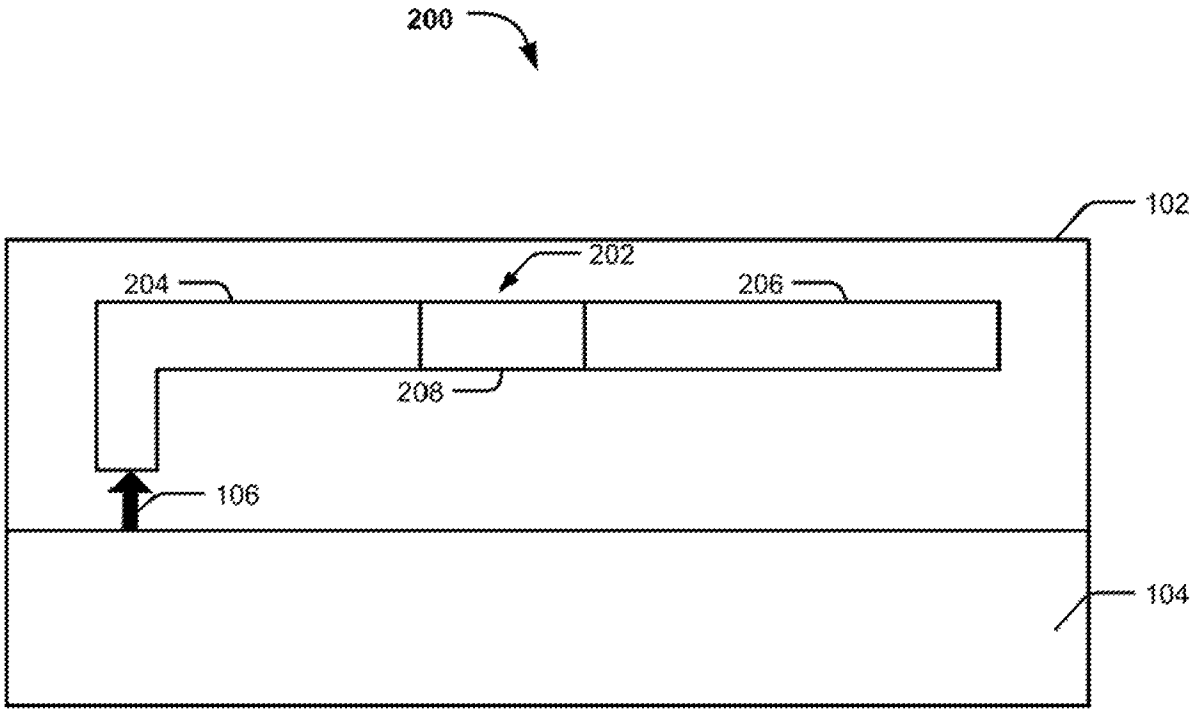
FIG. 2 illustrates an antenna element, according to another example.

FIG. 2 illustrates an antenna element 200, according to another example. The antenna element 200 includes the substrate 102, the ground plane 104, and the antenna feeder 106, as described with respect to FIG. 1. The antenna element 200 includes a segmented radiator 202. The radiator 202 may be made of metal traces. As shown in FIG. 2, the radiator 202 includes a first segment 204 and a second segment 206. The number of segments of the radiator 202 may not be construed as limiting and may depend on the frequency demands of the electronic device.

In this example, a lump component 208 is connected in series with the radiator 202. For series connection, the lump component 208 is longitudinally interposed between the first segment 204 and the second segment 206 of the radiator 202. Accordingly, due to the series connection of the lump component 208 with the radiator 202, the radiator 202 may behave as a monopole. As a result, the antenna thus formed would act as a monopole antenna. Therefore, the manner in which the lump component is connected, affects the behaviour of the antenna.

Figure 3:
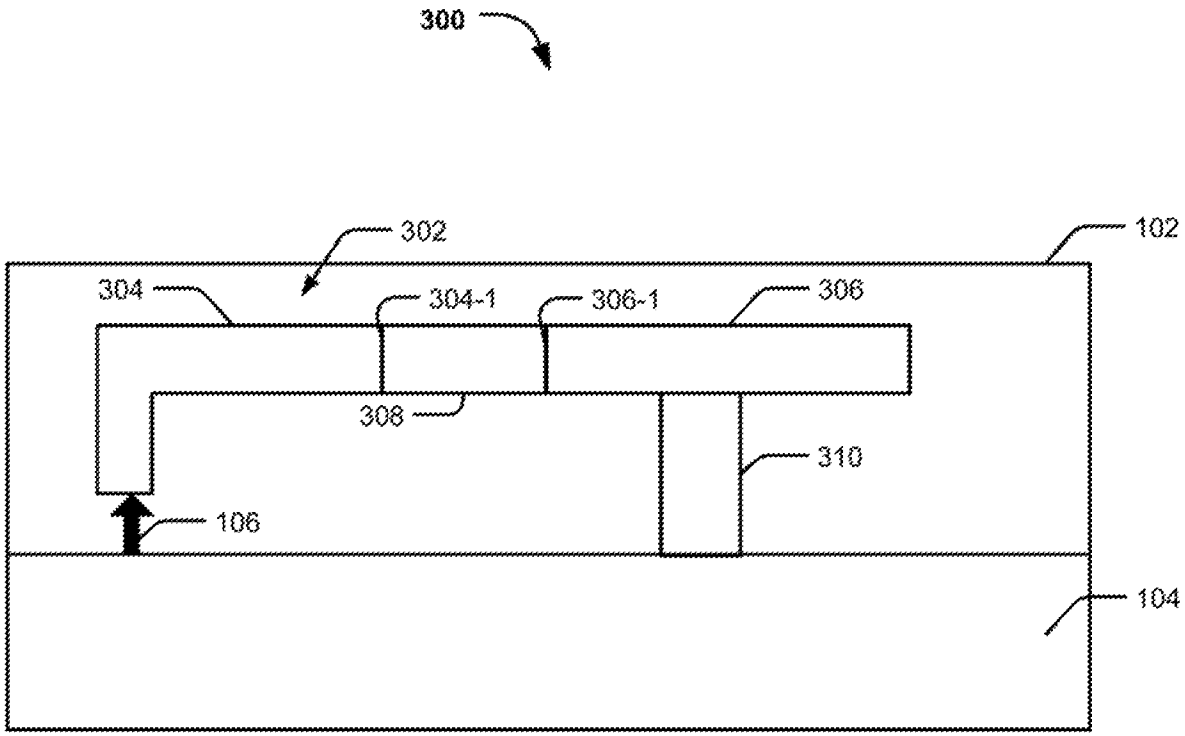
FIG. 3 illustrated an antenna element, according to yet another example.

FIG. 3 illustrates an antenna element 300, in accordance with another example of the present subject matter. The antenna element 300 includes the substrate 102, the ground plane 104, and the antenna feeder 106, as described with respect to FIG. 1. The antenna element 300 further includes a segmented radiator 302 having a first segment 304 and a second segment 306, similar to as described for the antenna element 200.

Further, the antenna element 300 includes two lump components, namely a first lump component 308 and a second lump component 310. The number of lump components may be increased or reduced. Further, the lump components 308 and 310 may be connected in any manner with the radiator 302. In an example, as shown in FIG. 3, the first lump component 308 is longitudinally interposed between the first segment 304 and the second segment 306 of the radiator 302. For this, the first lump component 308 connects one end 304-1 of the first segment 304 with one end 306-1 of the second segment 306 of the radiator 302.

Further, the second lump component 310 is connected with the radiator 302 in a parallel connection. For this, one end of the second lump component 310 is connected to the second segment 306 of the radiator 302. Another end of the second lump component 310 is shunted to the ground plane 104. The first lump component 308 and the second lump component 310 may facilitate in creating more resonance, thereby providing the frequency bandwidth for all frequency bands. In an example, the first lump component 308 and the second lump component 310 may include a resistor, a capacitor, or an inductor.

Figure 4:
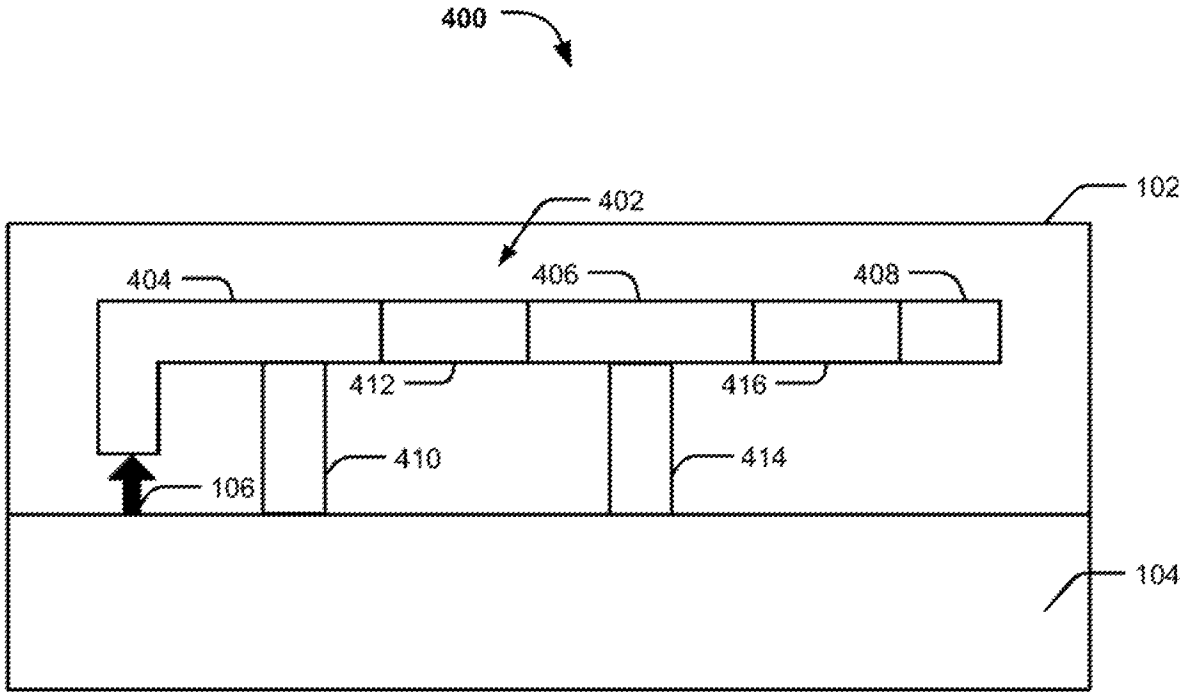
FIG. 4 illustrates an antenna element, according to yet another example.

FIG. 4 illustrates an antenna element 400, in accordance with another example of the present subject matter. The antenna element 300 includes the substrate 102, the ground plane 104, and the antenna feeder 106, as described with respect to FIG. 1. The antenna element 400 further includes a segmented radiator 402, The radiator 402 may include a first segment 404, a second segment 406, and a third segment 408. As mentioned previously, the number of segments of the radiator may not be construed as limiting and may depend on the frequency demands of the electronic device.

Further, the antenna element 400 includes four lump components, namely, a first lump component 410, a second lump component 412, a third lump component 414, and a fourth lump component 416, Further, the lump components 4110, 412, 414, and 416 may be connected in any manner to the radiator 402. As shown in FIG. 4, the first lump component 410 is connected with the radiator 402 in a parallel connection. Further, the second lump component 412 is longitudinally interposed between the first segment 404 and the second segment 406 of the radiator 402. In addition, the third lump component 414 is shunted between the second segment 406 of the radiator 402 and the ground plane 110. Further, the fourth lump component 416 is longitudinally interposed between the second segment 406 and the third segment 408 of the radiator 402.

In an example, the first lump component 410, the second lump component 412, the third lump component 414, and the fourth lump component 416 may include a resistor, a capacitor, or an inductor. The manner in which the lump components 410, 412, 414, and 416 are connected to the radiator 402 defines the way a slot-antenna may behave. For example, the lump components 410 and 416 which are connected in series with the radiator 402, causes the radiator 402 to behave as a monopole. On the other hand, the lump components 412 and 414 which are connected to the radiator 402 in parallel, causes the radiator 402 to behave like a loop.

Figure 5:
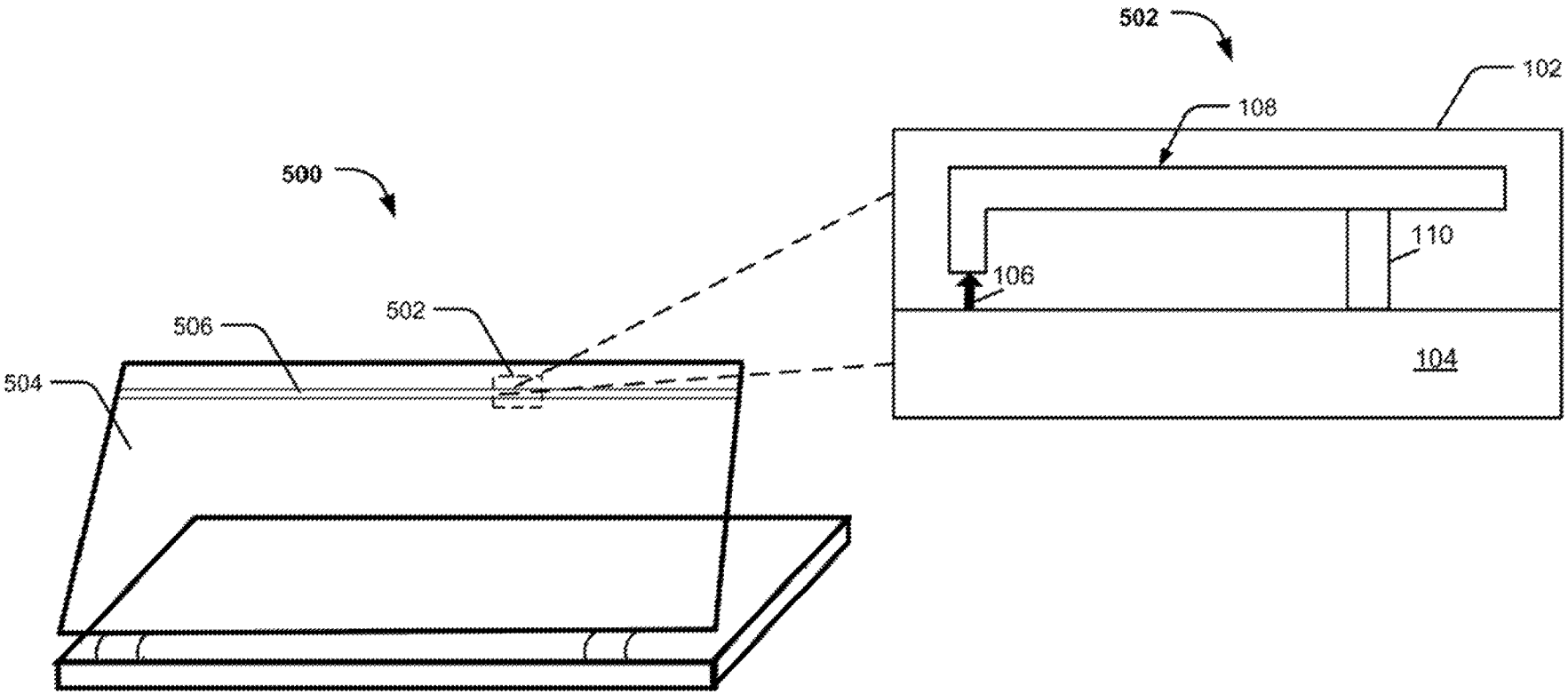
FIG. 5 illustrates an electronic device embedded with an antenna element, according to an example.

FIG. 5 illustrates an electronic device 500 embedded with an antenna element 502, in accordance with an example of the present subject matter. In the present example, the electronic device 500 is depicted as a laptop, however, the electronic device 500 may include a personal computer (PC), a smart hone, a tablet, a notebook, a mobile phone, and the like. The electronic device 500 includes a conductive enclosure 504 having a slot 506. The conductive enclosure 504 may be a case or a body of the electronic device 500. In an example, the conductive enclosure 504 may be of a metal, such as anodized aluminium, stainless steel, titanium, and the like.

Further, the slot 506 may extend throughout the conductive enclosure 504 of the electronic device 500 or may be at a specific region of the conductive enclosure 504. In an example, the slot 506 may be equal to or less than a quarter wavelength long at a lowest frequency interested. For example, if the frequency range for receiving signals for the slot antenna is between 698 MHz to 2690 MHz, 698 MHz is the lowest frequency interested.

The antenna element 502 is disposed on the conductive enclosure 504 to form a slot antenna. The antenna element 502 includes the substrate 102, the ground plane 104, and the antenna feeder 106. Further, the antenna element 502 includes a radiator, such as the radiator 108. In addition, the antenna element 502 includes a first lump component, such as the lump component 110 that connects the first segment of the radiator with the ground plane. The first lump component 110 may be a capacitor of about 2.0 picoFarad (pF). In an example, the antenna element 502 is similar to the antenna element 100; however, the antenna element 502 may be any of the antenna elements 200, 300, and 400 as explained with reference to FIGS. 2, 3, and 4. Thus, the radiator may include a first segment and a second segment, as shown in FIGS. 3 & 4. In addition, the antenna element 502 may include a second lump component (not shown). The second lump component may be longitudinally interposed between the first segment and the second segment of the radiator.

To fabricate the slot antenna, the antenna element 502 is placed over the slot 506 of the conductive enclosure 504 of the electronic device 500. The first lump component 110 may facilitate the electronic device 500 to transmit and receive signals at multiple frequency bands. For example, the electronic device 500 may transmit and receive signals between about 698 to about 2690 MHz for Wireless Wide Area Network (WWAN) Long Term Evolution (LTE) applications. Accordingly, the electronic device 500 may transmit and receive signals at a low band, a middle band, and a high band. Placement of the antenna element 502 over the slot 506 of the conductive enclosure 504 is explained in detail with reference to FIG. 6.

Figure 6:
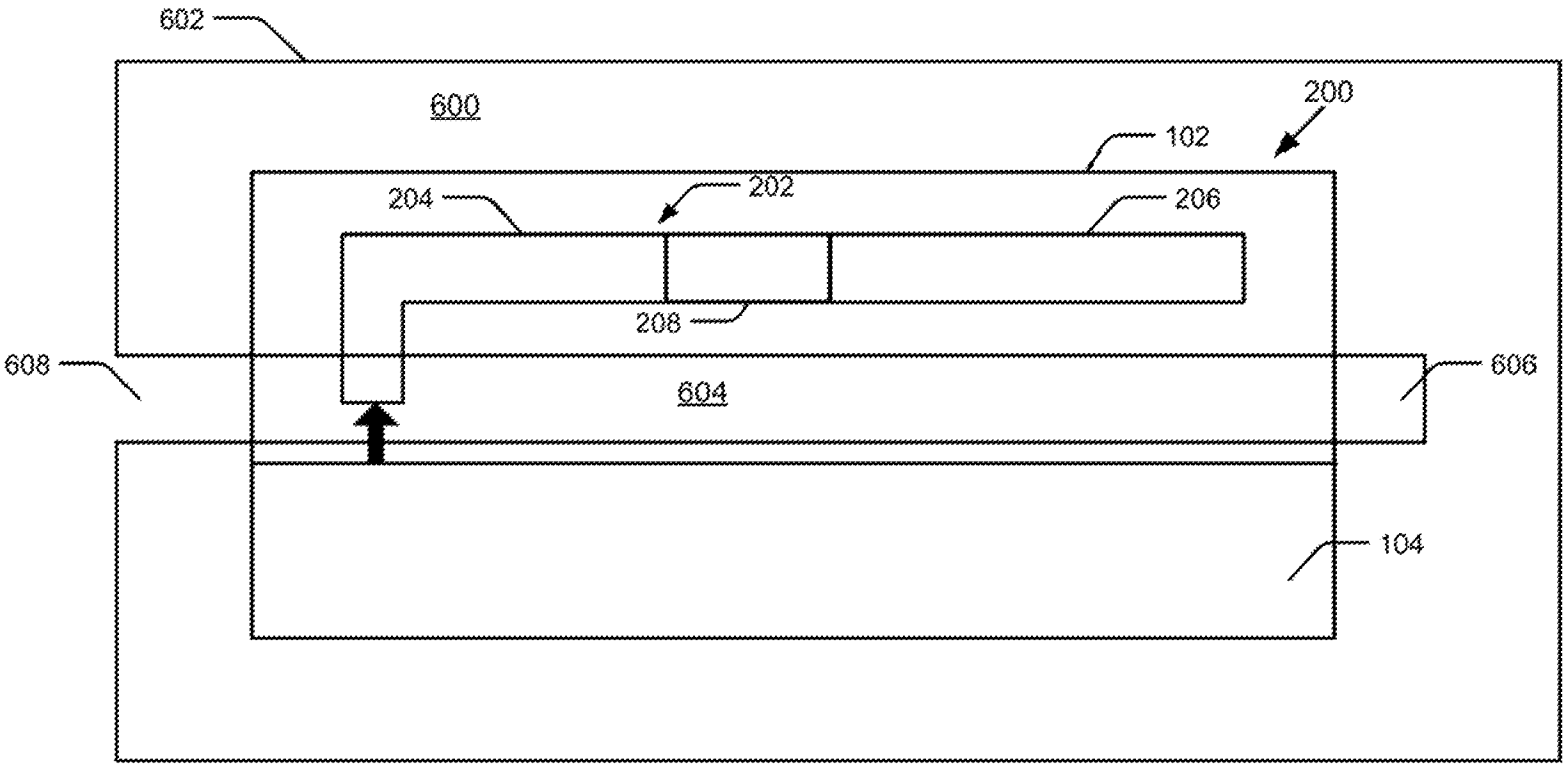
FIG. 6 illustrates an enclosure of an electronic device implementing an antenna element, according to an example.

FIG. 6 illustrates an inner surface 600 of an enclosure 602 of an electronic device, such as the electronic device 500, implementing the antenna element 200, according to another example. In an example, the enclosure 602 may include any of the antenna elements 100, 300, and 400 as explained with reference to FIGS. 1, 3, and 4. In an example, the enclosure 602 may be a body or housing of a mobile phone, a digital camera, a laptop, and the like. In an example, the enclosure 602 may be made of a conductive material. Examples of the conductive material may include, but are not limited to, Aluminium, Stainless Steel, and Titanium.

In an example, the enclosure 602 includes an antenna slot 604. The antenna slot 604 may be filled with a dielectric, such as air or a solid dielectric, such as plastic or epoxy that do not significantly affect radio-frequency antenna signals. The antenna slot 604 may be of any suitable shape and may be created on any portion of the enclosure 602. Further, the antenna slot 604 may extend throughout the enclosure 602 or may be at a specific region of the enclosure 602.

As depicted in FIG. 6, the antenna slot 604 is rectangular shape and includes a first end 606 and a second end 608. The shape of the antenna slot 604 may be selected to adjust a frequency response of the antenna. The length of the antenna slot may be, for example less than or equal to a quarter wavelength long at a lowest frequency interested. Further, the first end 606 of the antenna slot 604 is short-circuited and the second end 608 of the antenna slot 604 is open circuited, thereby providing a quarter wavelength antenna slot 604.

In an example, the enclosure 602 includes the antenna element 200 disposed at the inner surface 600 of the enclosure 602, as shown in FIG. 6. The antenna element 200 includes the substrate 102, such as a Flexible Printed Circuit (FPC) substrate. The antenna element 200 further includes the ground plane 104, and the antenna feeder 106. Further, the antenna element 200 includes a radiator, such as the radiator 202. The radiator 202 is segmented to include the first segment 204 and the second segment 206. In addition, the antenna element 200 includes the lump component, such as the first lump component 208.

In order to fabricate the slot antenna, the antenna element 200 is formed separately. For example, the antenna feeder 106, the radiator 108, and the lump component 110 are electrically coupled to the FPC substrate 102. Thereafter, the antenna element 200 may be attached to the inner surface 600 of the enclosure 602 such that the radiator 202 is placed over the antenna slot 506. In an example, the antenna element 200 is placed in such a manner that various components, such as the ground plane 104, the radiator 108, and the lump component 208 of the antenna element 200 come in contact with the inner surface 600 of the enclosure 602.

Figure 7:
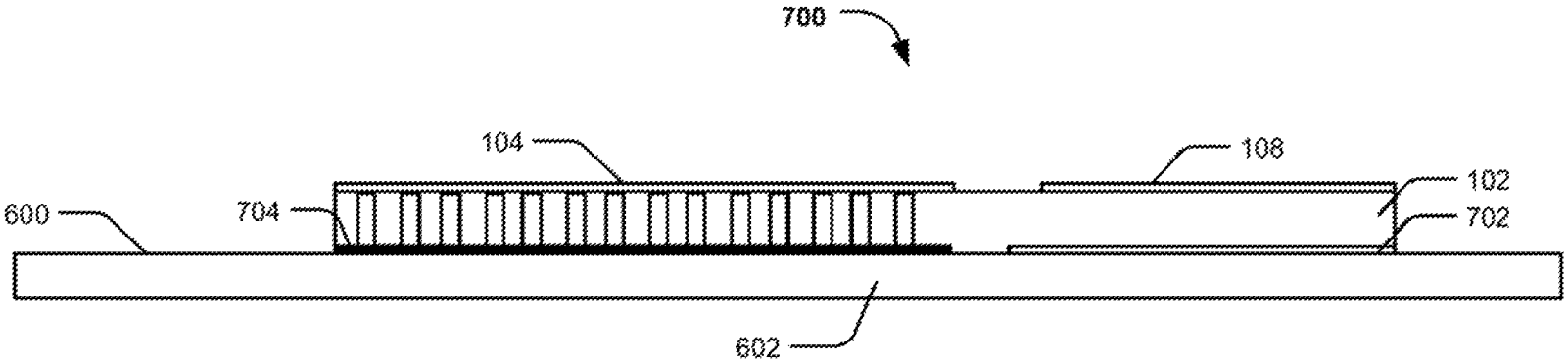
FIG. 7 illustrates a cross-sectional view of an enclosure of an electronic device implementing an antenna element, according to an example.

FIG. 7 illustrates a cross-sectional vies of the enclosure 602 of an electronic device implementing an antenna element 700, according to an example. In an example, the antenna element 700 is similar to the antenna element 100; however, the antenna element 700 may be any of the antenna elements 200, 300, and 400 as explained with reference FIGS. 2, 3, and 4. Further, as described with reference to FIG. 6, the enclosure 602 may be a conductive enclosure and may include the antenna element 700 disposed thereon.

The substrate 102 of the antenna element 700 may be attached to the inner surface 600 of the enclosure 602, by an adhesive layer, such as a non-conductive adhesive layer 702 and a conductive adhesive layer 704. In an example, the adhesive layers 702 and 704 may have variable thickness. For example, a region of the substrate 102 over which the radiator 108 is mounted, may be attached through a thin coating of the non-conductive adhesive layer 702. On the other hand, a region of the substrate 102 over which the ground plane 104 is mounted, may be attached through a thick coating of the conductive adhesive layer 704. To do so, a region of the substrate 102 over which the ground plane 104 is mounted, may be partially removed to have the ground plane 104 attached to the inner surface 600 through the conductive adhesive layer 704. In an example, the conductive adhesive layer 704 may be applied on the substrate 102 to attach the radiator 108 and the ground plane 104.

Examples of the conductive adhesives may include, but is not limited to, a glue composed of silver, copper or graphite. Examples of the non-conductive adhesives may include, but are not limited to, double-sided tapes.

Figure 8:
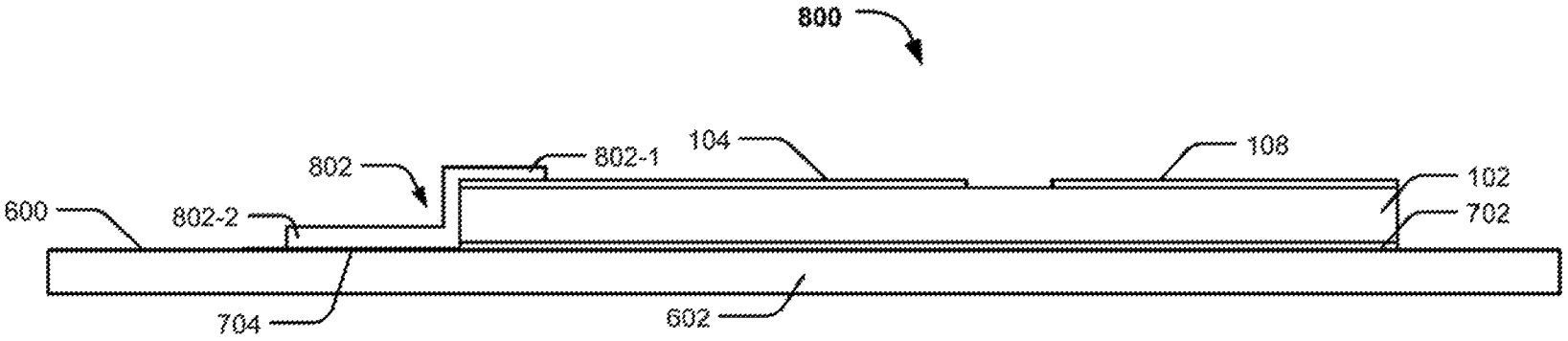
FIG. 8 illustrates another cross-sectional view of an enclosure of an electronic device implementing an antenna element, according to an example.

FIG. 8 illustrates another cross-sectional view of the enclosure 602 of an electronic device implementing an antenna element 800 according to an example. In an example, the antenna element 800 is similar to the antenna element 100; however, the antenna element 800 may be any of the antenna elements 200, 300, and 400 as explained with reference to FIGS. 2, 3, and 4. Further, as described with reference to FIG. 6, the enclosure 602 may be a conductive enclosure and may include the antenna element 800 disposed thereon.

In an aspect of the present subject matter, the substrate 102 of the antenna element 800 is attached to the inner surface 600 of the enclosure 602, by the non-conductive adhesive layer 702. Further, the ground plane 104 is connected to the enclosure 602 by a copper tape 802. As depicted in FIG. 8, a first end 802-1 of the copper tape 802 is attached to the ground plane 104 and a second end 802-2 of the copper tape 802 is connected to the inner surface 600 of the enclosure 602. In an example, the first end 802-1 of the copper tape 802 is soldered to the ground plane 104 and the second end 802-2 of the copper tape 802 is attached to the inner surface 600 of the enclosure 602 by the conductive adhesive 704.

Although implementations of the antenna elements 100, 200, 300, and 400, have been described in language specific to structural features and/or methods, it is to be understood that the present subject matter is not necessarily limited to the specific features or methods described. Rather, the specific features and methods are disclosed and explained in the context of a few example implementations of the antenna elements 100, 200, 300, and 400.

I claim:

1. An antenna element comprising:

a substrate to be disposed on a conductive enclosure of an electronic device, the substrate comprising a ground plane;

an antenna feeder electrically coupled to the ground plane of the substrate;

a first segment of a radiator being electrically connected to the antenna feeder to cause excitation of a slot in the conductive enclosure; and a lump component connected to a second segment of the radiator that is coupled to the first segment of the radiator, wherein the lump component connects the second segment of the radiator with the ground plane.

2. The antenna element as claimed in claim 1, wherein the substrate is a printed circuit substrate.

3. The antenna element as claimed in claim 1, wherein the lump component is connected to the radiator in series.

4. The antenna element as claimed in claim 1, wherein the lump component is connected to the radiator in parallel.

5. The antenna element as claimed in claim 1, wherein the lump component is one of a resistor, a capacitor, and an inductor.

6. An enclosure of an electronic device, the enclosure comprising:

an antenna slot; and an antenna element comprising:

a Flexible Printed Circuit (FPC) substrate disposed on the enclosure, the FPC substrate comprising a ground plane;

an antenna feeder electrically coupled to the ground plane of the FPC substrate;

a radiator placed on the slot to couple with the antenna feeder at one end; and a first lump component connected to the radiator, wherein the first lump component is longitudinally interposed between a first segment and a second segment of the radiator.

7. The enclosure as claimed in claim 6, wherein one end of the antenna slot is short-circuited and another end of the slot is open-circuited.

8. The enclosure as claimed in claim 7 further comprising a second lump component, wherein the second lump component connects the second segment of the radiator with the ground plane.

9. An electronic device comprising:

a conductive enclosure comprising a slot; and an antenna element mounted on the conductive enclosure, the antenna element comprising:

a substrate comprising a ground plane;

an antenna feeder electrically coupled to the ground plane of the substrate;

a radiator placed on the antenna slot with a first segment electrically coupled to the antenna feeder;

a first lump component electrically connected to a second segment of the radiator; and a second lump component longitudinally interposed between the first segment and the second segment of the radiator.

10. The electronic device as claimed in claim 9, wherein the slot is about a quarter wavelength long at a lowest frequency interested.

11. The electronic device as claimed in claim 9, wherein the first lump component connects the first segment of the radiator with the ground plane.

* * * * *